United States Patent [19]

Sasaki

[11] 4,034,691

[45] July 12, 1977

[54] SEWING MACHINE WITH A SUB-TABLE DEVICE

[75] Inventor: Tosio Sasaki, Inazawa, Japan

[73] Assignee: Brother Kogyo Kabushiki Kaisha, Nagoya, Japan

[21] Appl. No.: 658,969

[22] Filed: Feb. 18, 1976

[30] Foreign Application Priority Data

Mar. 4, 1975 Japan ..... 50-29995

[51] Int. Cl.[2] ..... D05B 75/00

[52] U.S. Cl. ..... 112/258

[58] Field of Search ..... 112/258, 260, 217.1

[56] References Cited

U.S. PATENT DOCUMENTS

| | | | |
|---|---|---|---|
| 3,557,732 | 1/1971 | Simon et al. | 112/258 |
| 3,570,431 | 3/1971 | Fresard | 112/258 |
| 3,587,500 | 6/1971 | Fresard | 112/258 |
| 3,646,900 | 3/1972 | Fresard | 112/258 |
| 3,683,833 | 8/1972 | Baruffa et al. | 112/258 |

FOREIGN PATENT DOCUMENTS

| | | | |
|---|---|---|---|
| 679,196 | 7/1939 | Germany | 112/260 |

*Primary Examiner*—George H. Krizmanich
*Attorney, Agent, or Firm*—George B. Oujevolk

[57] ABSTRACT

A sewing machine comprising a frame, including a base, a free lower arm having a work supporting surface, a base plate, and a sub-table device for converting the sewing machine from a free arm type to a flat bed type and vice versa. The sub-table device includes a connection plate and a support plate, said connection plate being hinged to the base plate in a manner to be turned between a fallen position, in which the connection plate extends horizontally from and frontwards of the end of the base plate, and a raised position in which said connection plate is set upright on the end of the base plate, and said support plate is hinged to said connection plate in a manner to be movable between a lower position in which same is folded in superposed relation to the connection plate which assumes the fallen position and an upper position in which said support plate rises upright in side by side relation to said lower arm, with its top surface substantially continuous with the work supporting surface of the free lower arm.

5 Claims, 7 Drawing Figures

SEWING MACHINE WITH A SUB-TABLE DEVICE

BACKGROUND OF THE INVENTION

This invention relates to a sewing machine equipped with a sub-table device for converting the sewing machine from a free arm type to a flat bed type, and vice versa.

A sewing machine is known which is adapted for sewing a flat sheet-like work piece or material, or for sewing a tubular work piece. Coupled with the fact that such a sewing machine has a frame of a peculiar construction, difficulty has been experienced in the procedure for converting the sewing machine into a free arm type. Furthermore, the sewing machine is very costly to manufacture. Upon converting such a sewing machine into a flat bed type, the work supporting surface substantially continuous with that of the free arm is stretched rearwards rather than frontwards of the free arm, resulting in the inaccuracy in guidance and shifting of a work piece.

SUMMARY OF THE INVENTION

According to a preferred embodiment of the present invention, there is provided a sewing machine which comprises a frame having a base, a free lower arm having a work supporting surface, a base plate, and a sub-table device for converting the sewing machine frame from a free arm type to a flat bed type, and vice versa, said sub-table device including a connection plate and a support plate, said connection plate being hinged to the front end of the base plate in a manner to be turned between a fallen position in which the connection plate extends horizontally from and frontwards of the base plate and a raised position in which said connection plate rises upright on the front end of the base plate, and said support plate is hinged to said connection plate in a manner to be movable between a lower position in which the support plate is superposed on the connection plate in the fallen position and an upper position in which said support plate is arranged in side by side relation to the free lower arm, with its top surface adjoining with and substantially continuous with the work supporting surface of the free lower arm at least in front of said free arm, when said connection plate assumes the raised position.

Where it is desired to use the sewing machine as a flat bed type machine, the support plate has to be moved to a position adjacent to the front end of the lower free arm, so that the top surface of the support plate provides a wide bed surface in association with the work supporting surface of the free lower arm, while the connection plate spans a front space left between the support plate and the base plate in a manner to entirely cover the space, thus giving a refined contour to the sewing machine when in the flat bed type. On the other hand, if the support plate is shifted to the lower position and the support plate and connection plate are brought into a collapsed state, then the free lower arm alone remains protruding from the base. Thus, the sewing machine is converted into the free arm type.

It is accordingly an object of the present invention to provide a sewing machine equipped with a sub-table device which may solve various drawbacks caused by conventional sewing machines.

It is another object of the present invention to provide a sewing machine equipped with a sub-table device, wherein the sewing machine may be converted with ease either to a free arm type or to a flat bed type.

It is a further object of the present invention to provide a sewing machine which is easy to handle when used as a flat bed type machine or as a free arm type machine, and which gives a refined contour to the sewing machine when set in a flat bed type.

DESCRIPTION OF PREFERRED EMBODIMENT

Figure 1:
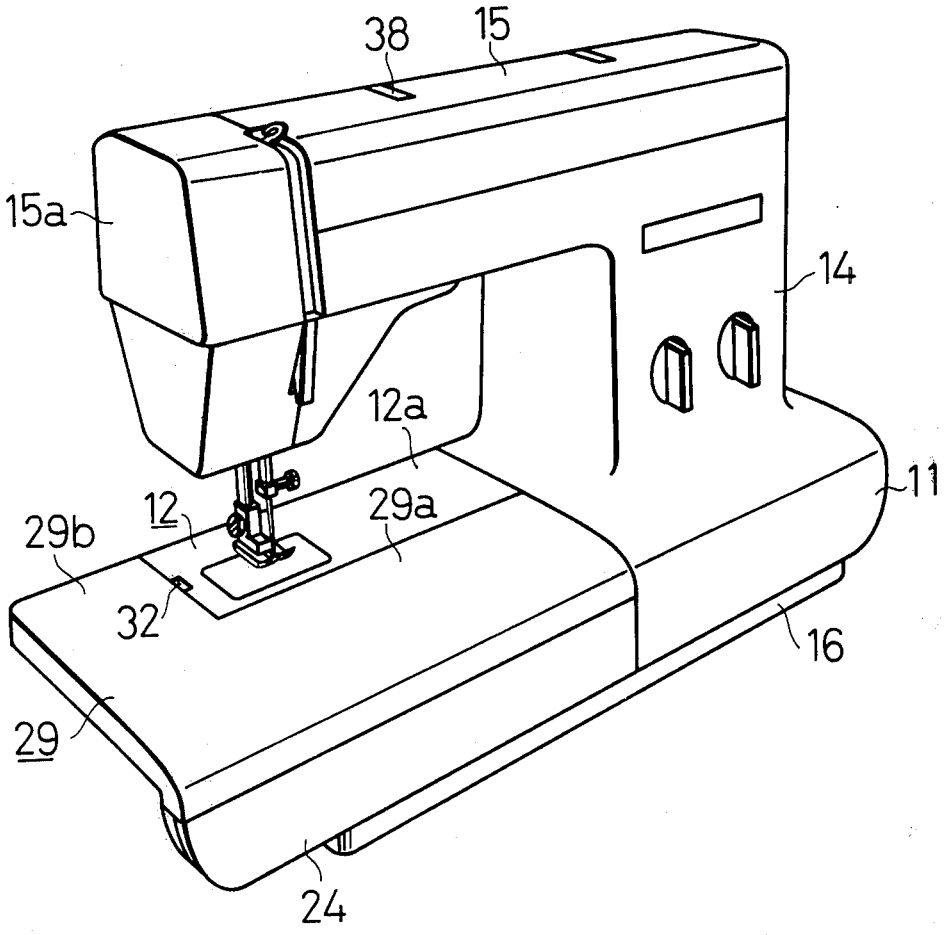
FIG. 1 is a perspective view of a sewing machine set in a flat bed type, in which the present invention is embodied.
Figure 2:
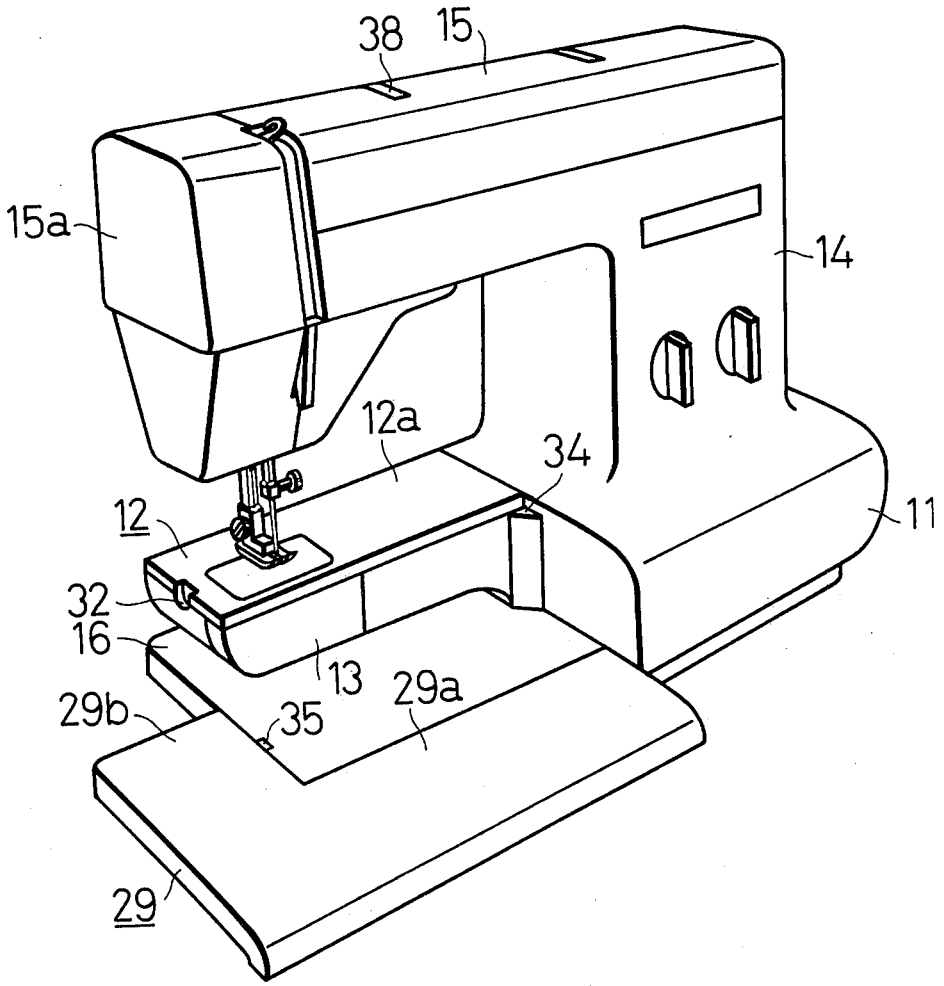
FIG. 2 is a perspective view of the sewing machine, converted into a free arm type.
Figure 3:
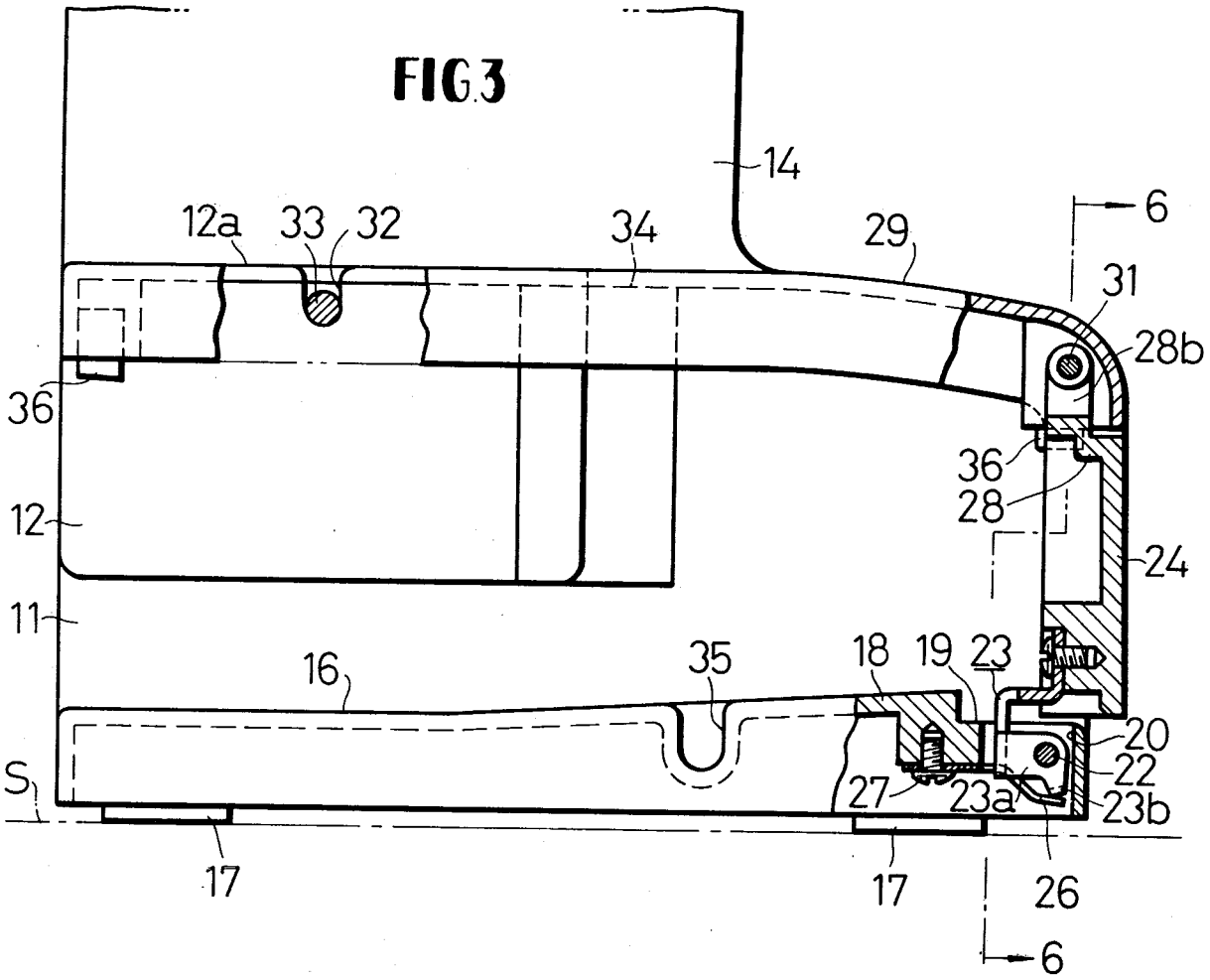
FIG. 3 is an enlarged side elevational view of the sewing machine of FIG. 1, shown with portions broken away.
Figure 4:
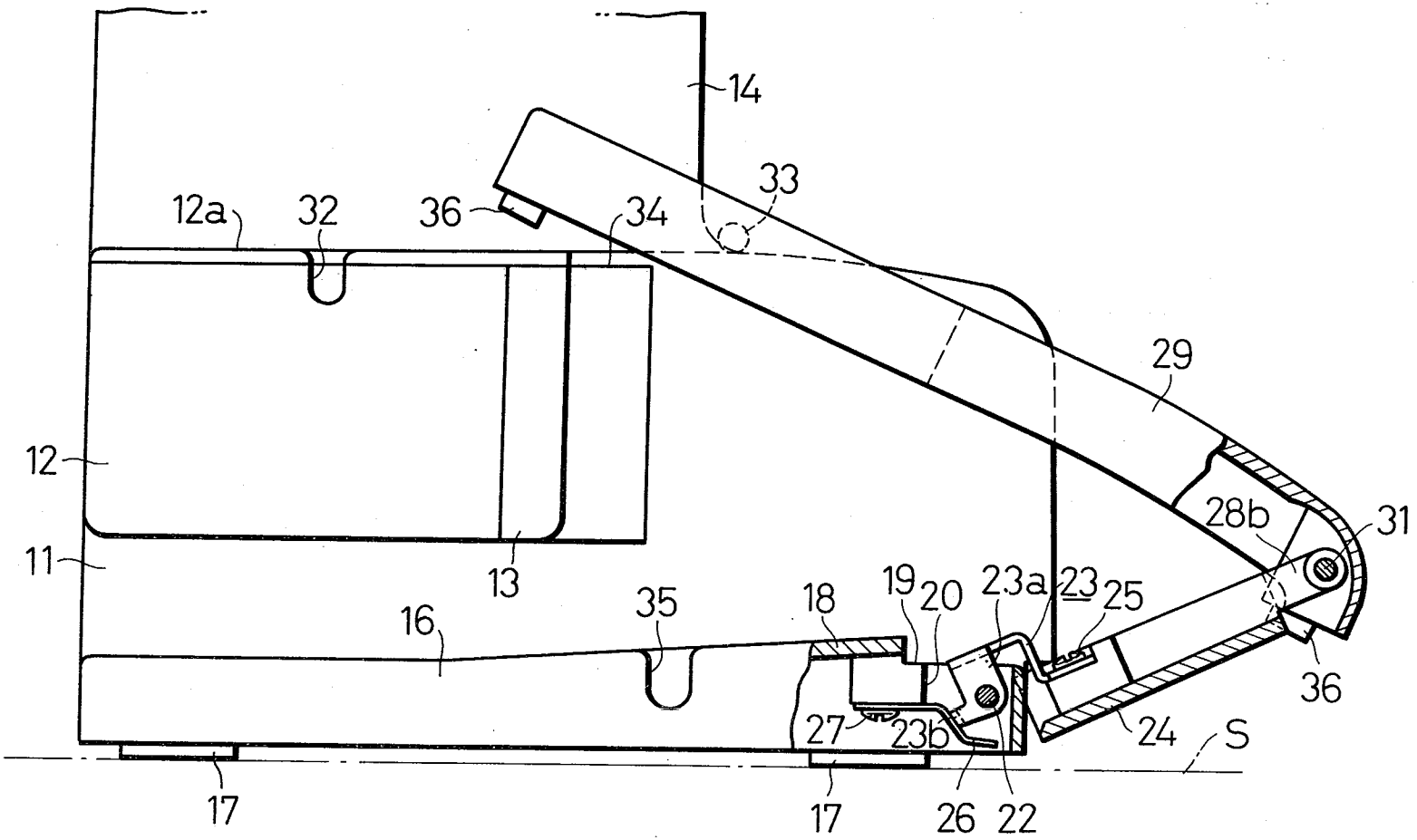
FIG. 4 illustrates the turning motion of a connection plate and a support plate.
Figure 5:
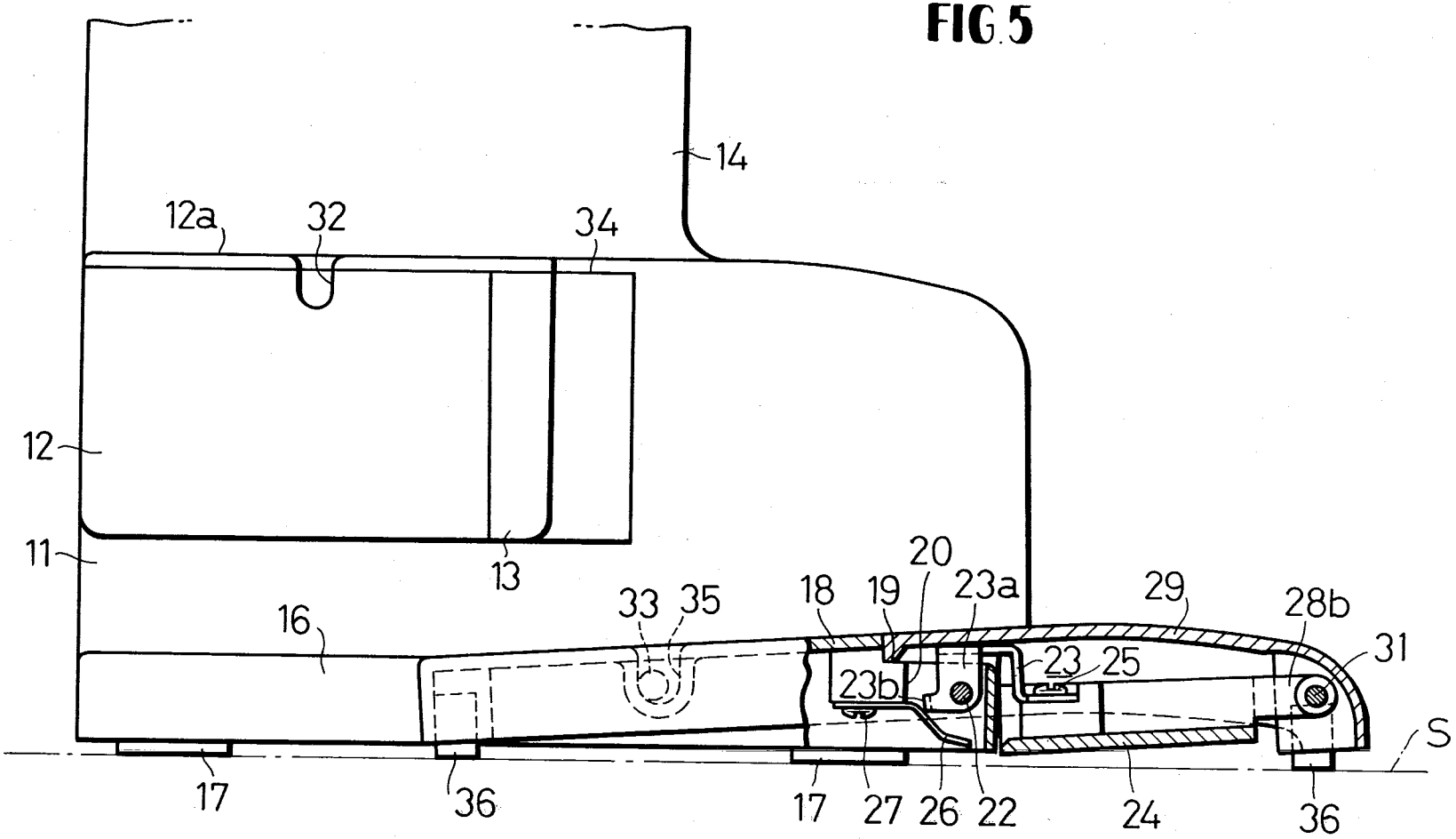
FIG. 5 is an enlarged side elevational view of the sewing machine of FIG. 2, shown with portions broken away.
Figure 6:
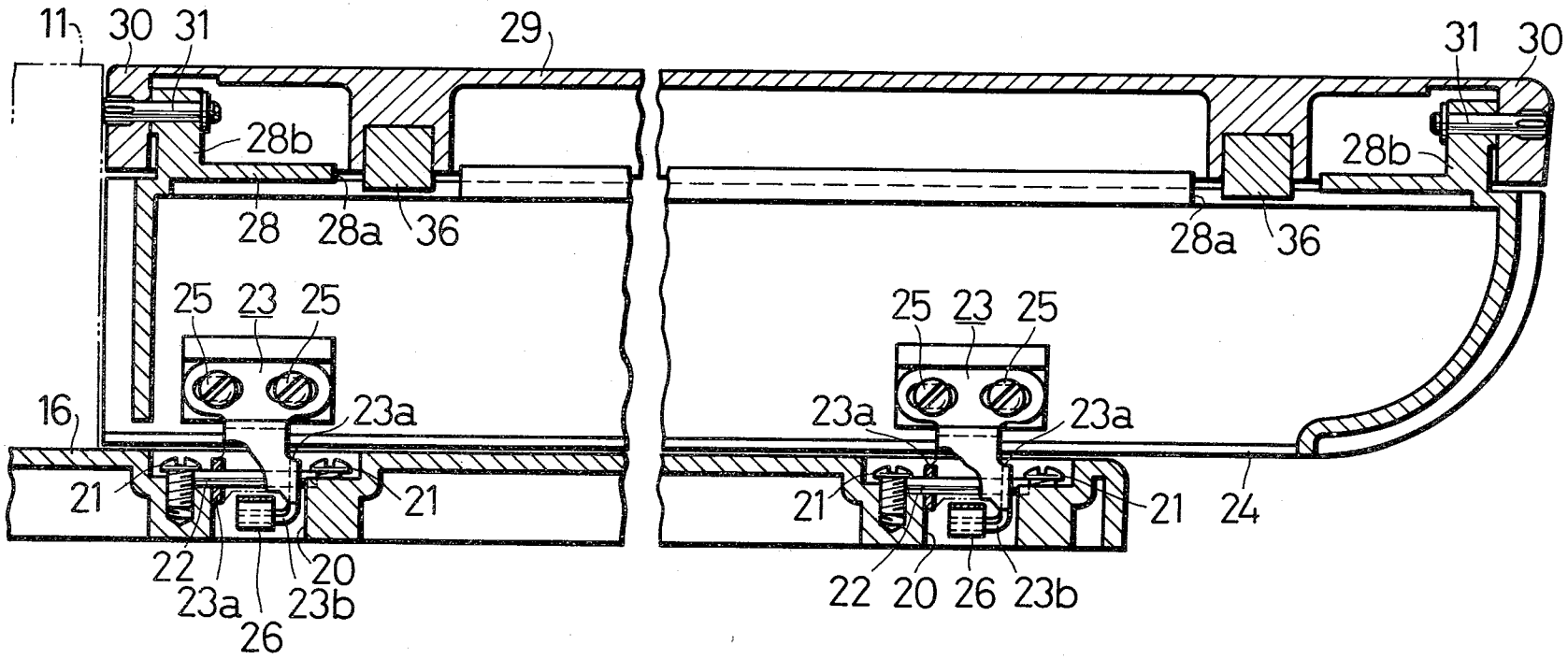
FIG. 6 is a longitudinal cross sectional view taken substantially along the line 6—6 of FIG. 3.

Description will be given to an embodiment with reference to the accompanying drawings. A sewing machine having a base 11, from the left rear side of which horizontally extends a lower arm 12 having a work supporting surface 12*a*. A cover 13 is openably attached to the front end of the lower arm 12, so that the cover 13 may be opened for placing or removing a bobbin case with an underthread bobbin in or from the lower arm 12. A standard 14 extends upright from the top rear portion of the base 11 intergrally therewith and has an upper arm 15 having a head 15*a* at one end. This upper arm extends from the upper left side of the standard 14 horizontally in parallel relation to the lower arm 12. A base plate 16 is rigid with the lower end portion of the base 11 and extends horizontally below the lower arm 12 at a given spacing from and in parallel to the lower arm, with its rear edge and left side edge aligned vertically with the rear edge and left side edge of the lower arm 12, as best seen in FIGS. 2 and 3. A plurality of rubber supporting legs 17 are attached in place onto the under surface of the base plate 16, so that the sewing machine may be stably held on a support surface S, such as a table, as seen in FIG. 3. A protruding portion 18 extends on the top surface of the base plate 16 between the rear and front ends thereof below the lower arm 12 and is included, presenting an upward slope toward the front end of the base plate. The upward slope of the protruding portion 18 terminates in a step recess 19, which has a bottom wall substantially on the same level with the rear top surface of the base plate 16, but lower than the top surface of the protruding portion 18, as seen in FIG. 3. The step recess 19 in the base plate 16 is provided with a pair of vertical through-holes 20 in the vicinity of the left and right sides of the step recess. A supporting shaft 22 horizontally spans each throughhole 20 and is fastened by means of a pair of screws 21, to the base plate 16 under the top surface of the step recess 19, as best seen in FIG. 6. There are provided a pair of attachment metal fittings 23 each having a pair of prongs 23*a* which are journaled on the supporting shaft 22. One of said pair of prongs has a projecting piece 23*b* at its one end, which is bent to extent substantially horizontally towards the end of the other prong 23 within respective through-hole 20, as seen in FIGS. 3 and 6. A connection plate 24, as seen in FIGS. 3 and 6, is fastened internally in the base portion thereof to the attachment metal fittings 23 by means of a pair of screws 25. The connection plate 24 is pivotally movable about the supporting shafts 22, so that the connection plate may be turned into a raised position in which same is set upright on the front end of the base plate 16, as seen in FIGS. 1 and 3, as well as into a tumbled position in which same extends from the front edge of the base plate 16 substantially horizontally towards a sewing machine operator, as seen in FIGS. 2 and 5. Leaf springs 26 are fixedly fastened by means of screws 27 to the under surface of the base plate 16 in the lower portions of the through-holes 20, respectively. The projecting pieces 23*b* of respective attachment metal fittings 23 are normally maintained urged on the upper surface of the free end of respective leaf springs 26. These leaf springs are adapted to be load-charged to urge the connection plate 24 towards the fallen position when the connection plate 24 is turned from the raised position shown in FIG. 3 via an intermediate turning position shown in FIG. 4 into the fallen position shown in FIG. 5, while respective leaf springs are adapted to be load-charged to urge the connection plate 24 towards the raised position when the connection plate 24 is turned from the fallen position via the intermediate position shown in FIG. 4 into the raised position. A rib 28 is built up on the back side of the connection plate 24 along the outer circumference except for the base portion thereof. The rib 28 is provided with a pair of through-holes 28*a* in the vicinity of the left and right sides thereof, and has a pair of attaching legs 28*b* which project upwards from the top of the rib 28 on the left and right sides thereof, as seen in FIG. 6.

A support plate 29 is composed of an elongated support plate portion 29*a* extending in the transverse direction of the machine, and a short support plate portion 29*b* extending in the longitudinal direction between the rear and front sides of the machine, thus presenting substantially an L-shape in plan view. A pair of attaching legs 30 project downwards from the under surface of the support plate 29 at the opposite extremities, and each have a supporting pin 31, which is fixedly secured at one end to the attaching leg 30 and project therefrom in a manner to be loosely fitted in the attaching legs 28*b* of the connection plate 24. Thus, the support plate 29 is turned about the supporting pins 31 into the upper position in which the support plate is arranged adjacent to the front and left end faces of the lower arm 12 when the connectionn plate 24 is set upright in the raised position, as shown in FIGS. 1 and 3, and in turn, into the lower position in which same becomes superposed on the connection plate when the latter is in the fallen position, as shown in FIGS. 2 and 5.

Provided in the left upper side of the lower arm 12 is a positioning recess 32, which has an open top and open side, as seen in FIGS. 2 and 3. A positioning pin 33 projects from the right side of the relatively short support plate portion 29*b* of the support plate 29 in a manner to be fitted in the positioning recess 32. When the support plate 29 is moved into the upper position, the positioning pin 33 will be fitted in the positioning recess, whereby the support plate 29 is maintained in closely contacting relation to the front and left end faces of the lower arm 12, with its upper surface being continuous with the work supporting surface 12*a* thereof. A positioning shoulder 34 projects from the front base portion of the lower arm 12 which is contiguous to the base 11, as seen in FIG. 2. The positioning shoulder 34 supports thereon the right-hand corner of the elongated support plate portion 29*a* when the support plate 29 assumes the upper position as shown in FIGS. 1 and 3. Thus, when the connection plate 24 is set in the raised position and the support plate 29 assumes the upper position, the upper surface of the support plate 29 is maintained continuous with the work supporting surface 12*a* of the lower arm, whereby both surfaces of plate 29 and arm 12 provide, in association, a wide spread of a work surface suited for use as a flat bed type machine. The support plate 29 in this condition is urged downwards and rearwards of the sewing machine by the action of the pair of leaf springs 26 provided in the base plate 16, so that there is no risk that a gap is created in the joint portion between the support plate 29 and the lower arm 12 due to an unwanted movement of the support plate 29 during the operation of the sewing machine.

Another positioning recess 35 is provided on the left side of the base plate 16 in a manner to receive therein the positioning pin 33 on the support plate 29. When the support plate 29 is turned into the lower position, with the rear end of the elongated support plate portion 29*a* resting in the step recess 19 of the base plate 16, the positioning pin 33 on the support plate 29 will be fitted in the positioning recess 35 in the base plate 16, thereby maintaining the top surface of the support plate 29 substantially continuous with the top surface of the base plate 16, in association with the step recess 19. When the connection plate 24 is turned into the fallen position as well as when the support plate 29 is moved into the lower position, both plates 24 and 29 are maintained folded in a superposed relation to each other on the side near to the sewing machine operator, and thus the sewing machine assumes the free arm type. Under this condition, the support plate 29 is urged downwards of the machine by the action of the pair of leaf springs 26 provided in the base plate 16, such that an unwanted movement of the support plate 29 during the operation of the sewing machine is prevented, with the assurance of the stable sewing.

A plurality of rubber supports 36 are provided on the under surface of the support plate 29. Two supports 36 of these supports are provided in facing relation to the pair of through-holes 28*a* in the rib 28 which extends along the under surface of the connection plate 24 in a manner to be free to pass through the pair of through-holes 28*a* at the time of the relative turning of the connection plate 24 to the support plate 29. These supporting legs 36 retain the support plate 29 stably on the support surface S during the operation of the sewing machine, with the connection plate and support plate collapsed in superposed relation to each other on this side of the sewing machine operator.

Figure 7:
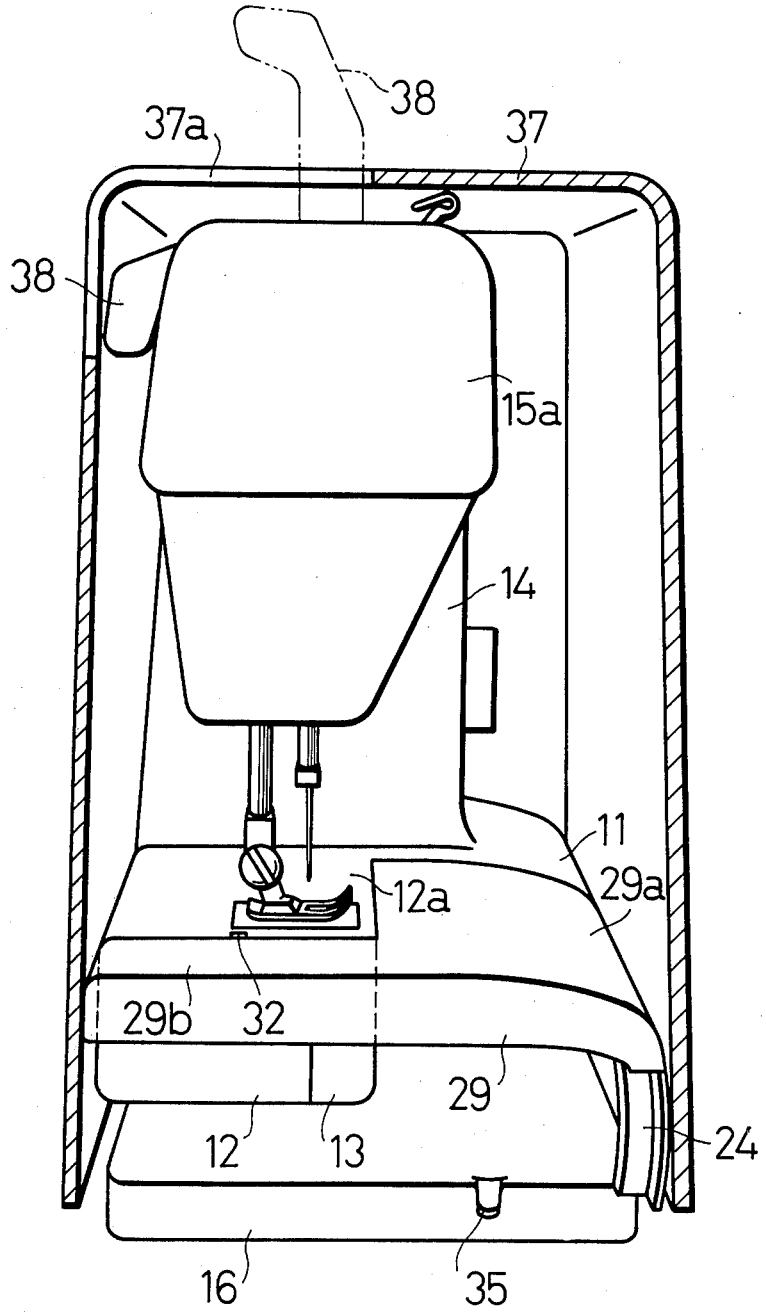
FIG. 7 is a perspective view, as viewed from the left, of the sewing machine of FIG. 1 having a hood mounted thereon, but shown with part of the hood broken away.

A machine hood 37 has an open bottom so that the hood 37 may be put on the sewing machine body from above and cover almost entirely the sewing machine body except for the base plate portion 16, as the sewing machine assumes a flat bed configuration, with the support plate 29 located in the upper position, as shown in FIG. 7. A handle 38 for carrying is rotatably mounted on the upper arm 15 and adapted to be folded rearwards of the upper arm in the manner shown by a solid line in FIG. 7, during the operation of the sewing machine, and on the other hand, when carrying the sewing machine, the handle is raised to extent through a through-hole 37*a* in the hood 37 in the manner shown by a dotted line in FIG. 7, so that the sewing machine will be carried away to a desired place with the hood 37 put thereon.

In operation, when the sewing machine assumes a flat bed configuration, with the connection plate 24 and the support plate 29 maintained in the raised position and the upper position, respectively, as shown in FIGS. 1 and 3, the positioning pin 33 provided on the support plate 29 will be fitted in the positioning cavity 32 provided in the lower arm 12 as well as the right rear end of the support plate 29 will be rested on the positioning shoulder 34. Thus, the support plate is held in place adjacent to the front and left sides of the lower arm with its top surface being continuous with the work supporting surface 12*a* of the lower arm 12. Furthermore, by virtue of the action of the pair of leaf springs 26 which normally urge the support plate 29 in the lower rear direction of the sewing machine, the support plate 29 is maintained in that position, without a risk of a gap being created in the joint portion between the support plate and the lower arm 12 due to an unwanted movement of the support plate during the operation of the sewing machine. Thus, when the sewing machine assumes a flat bed configuration, the sewing machine operator can conduct the sewing safely and with ease, using a wide spread of work surface covering the work supporting surface 12*a* of the lower arm 12 and the substantially L-shaped surface of the support plate 29 without one's hand or part of a workpiece being bitten into the joint portion between the support plate 29 and the lower arm 12.

When it is desired to convert the sewing machine from the flat bed type into the free arm type, the support plate 29, located in the upper position in FIGS. 1 and 3, is pulled upwards by the left rear end and the connection plate 24 is turned against the force of the leaf springs 26 toward the fallen position. Just when the connection plate 24 has passed the intermediate turning position shown in FIG. 4, the action of the pair of leaf springs 26 is reversed, whereby the connection plate 24 is automatically turned into the fallen position as shown in FIG. 5 under the action of the leaf springs 26. Subsequently, if the support plate 29 is turned until it is folded in superposed relation to the connection plate 24 located in the fallen position as shown in FIGS. 2 and 5, then the positioning pin 33 projecting from the support plate 29 will be fitted in the positioning cavity 35 provided in the base plate 16 as well as the rear edge of the elongated support plate portion 29*a* of the support plate 29 comes to rest on the wall of the step recess 19 provided along the front end of the base plate 16, thus the support plate 29 is held in place with its top surface being substantially continuous with the top surface of the base plate 16. The support plate 29 is maintained stably in this condition, without being accidentally sprung upwards in front of the base plate 16 during the operation of the sewing machine, and hence the support plate 29 does not interfere with the sewing due to an unwanted movement. Thus, a sewing machine operator can do sewing work, using the sewing machine assuming the free arm configuration, without a risk that her hand or part of a work piece is bitten into the joint portion between the support plate 29 and the base plate 16. In this situation, the support plate 29 is maintained in an urged downwards condition by the action of the leaf springs 26 as well as held stably on the support surface S, such as a table, by means of the plurality of rubber supports 36 provided on the under surface of the support plate 29, with the freedom of an unwanted movement during the operation of the sewing machine, thus ensuring the stable performance of the sewing machine.

Where it is desired to convert the sewing machine from the free arm type into the flat bed type, the support plate 29 located in the lower position shown in FIGS. 2 and 5 is pulled upwards by the left rear portion thereof and the connection plate 24 is turned towards the raised position against the force of the leaf springs 26. Just when the connection plate 24 has passed the intermediate turning position as shown in FIG. 4, the action of the leaf springs 26 is reversed, whereby the connection plate 24 is automatically turned by the action of the leaf springs 26 into the raised position as shown in FIGS. 1 and 3. Subsequently, the support plate 29 is turned towards the upper position. When the positioning pin 33 projecting from the support plate 29 is fitted in the positioning cavity 32 provided in the lower arm 12 as shown in FIGS. 1 and 3, the support plate 29 is set in side by side relation to the lower arm 12 with its top surface being substantially continuous with the work supporting surface 12*a* of the lower arm 12, thus providing the flat bed configuration for the sewing machine.

Where exchange of one bobbin with another is desired during use of the sewing machine, the sewing machine is converted into the free arm type by turning or tumbling the connection plate 24 and support plate 29 in the collapsed state on the side of the sewing machine operator, and then the cover 13 attached to the front left portion of the lower arm 12 is pulled open, so that the bobbin will be removed from the sewing machine with ease. After use, the sewing machine, if it assumes the free arm configuration, should preferably be converted into the flat bed configuration, so that the sewing machine may be entirely covered with the hood 37 from above. The handle 38 on the upper arm 15 is raised in the manner shown by the dotted line in FIG. 7, so that the sewing machine may be carried to a desired place, with the hood thereon. In this embodiment, arrangement is made that the lower arm 12 extends from the left rear portion of the base 11, with its rear edge vertically aligned with the rear edge of the base plate 16, and the front face of the connection plate 24, when the sewing machine assumes a flat bed configuration aligned with the front face of the base 11, for compactness in size of the sewing machine, thus permitting the use of a comparatively small hood 37 for entirely covering the sewing machine.

The present invention yields the following results and effects:

1. According to the present invention, when the connection plate pivotally hinged to the front end of the base plate is turned into the raised position, and at the same time, the support plate pivotally hinged to the front end of the connection plate is set to the upper position in which same is arranged in side by side relation to the lower arm, then the lower arm and the support plate provide, in association, a wide spread of flat bed and thus the sewing machine assumes the flat bed configuration. On the other hand, when the connection plate is turned into the fallen position, the support plate is set in the lower position is superposed relation to the connection plate, and the both plates are folded on this side of the sewing machine operator, then the sewing machine assumes the free arm configutation. This construction is advantageous in the points that there is no fear of the support plate being missed and that the sewing machine can be converted into a free arm type or into a flat bed type by the extremely simple manipulation, as the base may be, unlike the sewing machine in which such a support plate is mounted or dismounted from the front portion of the lower arm of the free arm type machine.

2. When the sewing machine assumes a flat bed configuration, the top surface of the support plate is maintained continuous with the work supporting surface of the lower arm by the positioning means provided in the support plate and the lower arm, and the support plate may be held stably in that position during the operation of the sewing machine. Thus, a sewing machine operator may use the sewing machine in safety, without a possibility of her hand or part of a work piece being bitten into the joint portion between the support plate and the lower arm.

3. According to the present invention, the support plate is given substantially an L-shape in plan view, so that the support plate may be accommodated to the front and left side portion of the lower arm, when the sewing machine assumes a flat bed configuration thereby providing a wide spread of work surface.

4. When the sewing machine takes the free arm configuration, the support plate and the connection plate are maintained in the collapsed state on this side of a sewing machine operator, without being accidentally raised up in front of the base plate, thus ensuring the smooth sewing as well as permitting the smooth opening and closing of the cover plate for bobbin exchange, which is attached to the front face of the lower arm.

5. When the sewing machine assumes the free arm configuration, the support plate is supported at one end on the step recess provided in the base plate, with its top surface being substantially continuous with the top surface of the base plate. According to the present invention, the support plate always remains incorporated as part of the sewing machine, without the possibility of interference with the sewing, and a sewing machine operator therefore may use the sewing machine with safety without risk of her hand or part of a work piece being bitten into the joint portion between the support plate and the base plate.

6. When the connection plate is turned from the fallen position toward the raised position and has passed the predetermined intermediate position in the course of the movement toward the raised position, the force urging the connection plate towards the raised position is exerted on the connection plate by the spring means confined between the connection plate and the base plate. On the contrary, when the connection plate is turned from a predetermined raised position toward the fallen position, the force urging the connection plate towards the fallen position is exerted on the connection plate by the action of the spring means. Thus, the support plate may be set with ease by one touch manipulation either to the position for a flat bed configuration or to the position for a free arm configuration. Furthermore, the support plate may be maintained stably in either position with the freedom of an unwanted movement during service of the sewing machine.

7. According to the present invention, a single solid plate is used as the connection plate and secured to the front portion of the base plate, so that the connection plate covers entirely the front space left between the support plate and the base plate, when assuming the flat bed configuration as shown in FIG. 1, thus giving a box-like refined contour to the sewing machine.

I claim:

1. In a sewing machine having a frame which includes:

a. a base (11), b. a free lower arm (12) extending horizontally from said base and having a work supporting surface, c. a standard (14) rising above said base, d. an upper arm (15) extending from said standard generally parallel to said lower arm, and e. a base plate (16) mounted under said base and extending generally parallel to and under said lower arm, a sub-table device for converting said sewing machine from a free arm type to a flat bed type, comprising:

f. a connection plate (24) hinged to said base plate at a front edge thereof for movement between a fallen position in which said connection plate extends forwards from the front edge of the base plate and a raised position in which the connection plate rises above at the front edge of the base plate, g. a support plate (29) hinged to said connection plate and adapted to shift between a lower position in which said support plate superposes on the connection plate in said fallen position and an upper position in which said support plate adjoins the front edge of said lower arm in the raised position of said connection plate, h. means (32, 33) on said support plate and said lower arm for holding the support plate in said upper position when the support plate is shifted from said lower position to the upper position, in which a top surface of said support plate is substantially continuous with the work supporting surface of said lower arm, and, i. spring means (26) mounted between the base plate and the connection plate and functioning on one side of a predetermined position in the movement path of said connection plate to move the latter to the raised position and functioning on the other side of said predetermined position to move the connection plate to the fallen position.

2. A sewing machine according to claim 11, wherein said base plate (16) has a step recess (19) extending parallel to the front edge of the base plate, and said support plate (29) is adapted to lie on said step recess at a free edge of the support plate in the lower position thereof, so that a substantially smooth continuous surface is formed with a top surface of said base plate and an exterior surface of said support plate in said lower position.

3. A sewing machine according to claim 1, wherein said support plate (29) is substantially L-shaped, and when the support plate is held in the upper position the substantially smooth surface continuous with the work supporting surface of the lower arm is formed both forwards and sidewards of said work supporting surface.

4. In a sewing machine having a frame which includes:

a. a base (11), b. a free lower arm (12) extending horizontally from said base and having a work supporting surface, said lower arm being situated relatively rearwards of said base, c. a standard (14) rising above from a part of said base, d. an upper arm (15) extending from said standard generally parallel to said lower arm, and e. a base plate (16) mounted under said base and extending generally parallel to and under said lower arm, a sub-table device for converting said sewing machine from a free arm type to a flat bed type, comprising:

f. a single connection plate (24) hinged to said base plate at a front edge thereof for movement between a fallen position in which said connection plate extends forwards from the front edge of the base plate and a raised position in which the connection plate rises above at the front edge of the base plate with the front surface of said connection plate aligned with the front surface of the base, g. a support plate (29) hinged to said connection plate for shifting between a lower position in which said support plate superposes on the connection plate in said fallen position and an upper position in which said support plate adjoins the front edge of said lower arm and the side edge of said base in the raised position of said connection plate, and h. means (32, 33) on said support plate and said lower arm for holding said support plate in said upper position when the support plate is shifted from said lower position to the upper position, in which a top surface of said support plate is substantially continuous with the work supporting surface of said lower arm and a top surface of said base.

5. A sewing machine according to claim 4, wherein a rear wall of the lower arm is substantially continuous with a rear wall of the base, thereby an area enclosed by the open edge of the base, the lower arm and the support plate in the raised position thereof is substantially rectangular in a plan view.

* * * * *